US010786012B2

(12) United States Patent
Li et al.

(10) Patent No.: US 10,786,012 B2
(45) Date of Patent: Sep. 29, 2020

(54) ELECTRONIC CIGARETTE, ATOMIZER AND AIRFLOW REGULATOR THEREOF

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Fubao Luo, Shenzhen (CN); Xiaoqiang Zhao, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 324 days.

(21) Appl. No.: 16/003,073

(22) Filed: Jun. 7, 2018

(65) Prior Publication Data

US 2018/0279691 A1 Oct. 4, 2018

(30) Foreign Application Priority Data

Jun. 7, 2017 (CN) ..... 2017 2 0657182 U

(51) Int. Cl.

| | |
|---|---|
| ***A24F 13/00*** | (2006.01) |
| ***A24F 47/00*** | (2020.01) |
| ***A24F 7/00*** | (2006.01) |

(52) U.S. Cl.
CPC ..... *A24F 47/008* (2013.01); *A24F 7/00* (2013.01)

(58) Field of Classification Search
CPC ..... A24F 47/00
USPC ..... 131/328–329
See application file for complete search history.

(56) References Cited

U.S. PATENT DOCUMENTS 10,172,393 B2 * 1/2019 Li ..... H05B 3/42

* cited by examiner

*Primary Examiner* — Phuong K Dinh
(74) *Attorney, Agent, or Firm* — Cheng-Ju Chiang

(57) ABSTRACT

An airflow regulator has a main ring body and a regulating ring piece. The main ring body is a hollow structure and a sidewall thereof comprises an air inlet. The regulating ring piece is disposed on a bottom of an inner periphery of the main ring body. The regulating ring piece is used to deform correspondingly according to a magnitude of pressure of incoming airflows passing through the air inlet. An electronic cigarette and an atomizer having the airflow regulator are structurally novel and convenient to use. The regulating ring piece of the airflow regulator can correspondingly deform according to magnitudes of sucking forces of the user when the user smokes in order to automatically adjust an amount of air intake.

19 Claims, 6 Drawing Sheets

ELECTRONIC CIGARETTE, ATOMIZER AND AIRFLOW REGULATOR THEREOF

BACKGROUND OF THE INVENTION

1. Field of the Invention

The present invention relates to a technical field of electronic cigarettes, particularly to an electronic cigarette, an atomizer and its airflow regulator.

2. The Related Arts

Existing atomizers are mostly designed to adjust an amount of airflows via an airflow adjusting ring, or designed to set a fixed amount of airflows.

For an atomizer using the airflow adjusting ring to adjust the amount of airflows, it is required to manually adjust the airflow adjusting ring. Such manual adjustment process is complicated, and is difficult for a particular user to accurately adjust the amount of airflows suitable for the particular user himself. As a result, feelings of larger sucking resistance or nothing to be smoked become common smoking experience for the particular user. In addition, parts for the airflow adjusting ring require higher cost and complicated structures to be made.

For an atomizer having a fixed amount of airflows, feelings of larger sucking resistance or nothing to be smoked are common for its users. User experience is therefore poorer.

SUMMARY OF THE INVENTION

An electronic cigarette, an atomizer and an airflow regulator thereof in accordance with the present invention is therefore provided in order to solve technical problem of poor smoking experience caused by existing technology by using airflow adjusting rings to adjust an amount of airflows or by setting to have a fixed amount of airflows.

To solve the above mentioned technical problem, a technical solution in according with the present invention is to provide an airflow regulator. The airflow regulator comprises a main ring body and a regulating ring piece. The main ring body is a hollow structure and a sidewall thereof comprises an air inlet. The regulating ring piece is disposed on an inner periphery of the hollow structure, that is the main ring body, in which, the regulating ring piece extends from a bottom of the inner periphery of the main ring body toward a centre of the main ring body, the regulating ring piece is used to deform correspondingly according to magnitudes of pressures of incoming airflows passing through the air inlet.

According to an embodiment of the present invention, a cutting line is formed along a radial direction of the regulating ring piece.

According to an embodiment of the present invention, a notch is formed along a radial direction of the main ring body.

According to an embodiment of the present invention, a counterbore is disposed at a top face of the main ring body.

According to an embodiment of the present invention, an engaging portion is disposed at an outer periphery of the main ring body.

To solve the above mentioned technical problem, another technical solution in according with the present invention is to provide an atomizer. The atomizer comprises a main unit, a suction nozzle connected to the main unit and the airflow regulator described above. The airflow regulator is disposed between the main unit and the suction nozzle. The regulating ring piece of the airflow regulator is used to correspondingly deform according to magnitudes of pressures of airflows passing through the air inlet into an inside of the main unit.

According to an embodiment of the present invention, the suction nozzle comprises a body portion, an intake ring portion and a threaded portion which are sequentially connected to one another. The air intake ring portion comprises an air intake slot. External air sequentially passes through the air intake slot, the air inlet and the regulating ring piece into the main unit. The threaded portion is used to be connected with a thread of the main unit.

According to an embodiment of the present invention, the suction nozzle further comprises an inner contact platform, an inner sleeve and an inner rib. The inner contact platform is used to be pressingly engaged around an outer periphery of the main ring body. The inner sleeve is used to be connectively sleeved with the inner periphery of the main ring body. The inner rib is used to be engaged and fit with a top face of the main ring body.

According to an embodiment of the present invention, the main unit comprises an outer cylinder, an atomizing assembly, a central conduit and an electrical connection base. An oil reservoir is formed between an inner periphery of the outer cylinder and an outer periphery of the atomizing assembly. Both ends of the central conduit are respectively connected with the inner sleeve and the atomizing assembly. The regulating ring piece is resiliently engaged around an outer peripheral wall of the central conduit. The electrical connection base is connected to a bottom of the outer cylinder in order to supply power to the atomizing assembly.

To solve the above mentioned technical problem, another technical solution in according with the present invention is to provide an electronic cigarette. The electronic cigarette comprises a battery module and the atomizer as depicted above.

Beneficial advantages of the present invention are as below. Distinguished from situations of existing technology, the electronic cigarette, the atomizer and the airflow regulator thereof in accordance with the present invention are structurally novel and convenient to use, and the regulating ring piece thereof can correspondingly deform according to magnitudes of sucking forces of the user when the user smokes in order to automatically adjust an amount of air intake. As a result, smoking experience of the user can be extremely enhanced.

BRIEF DESCRIPTION OF THE DRAWINGS

In order to more explicitly explain technical solutions in accordance with an embodiment of the present invention, appendix drawings required to be used for description(s) of embodiment(s) in accordance with the present invention will be briefly described below. Obviously, the drawings described as following are only certain embodiment(s) of the present invention. For those of ordinary skilled in the art, other drawings can be further obtained based on these drawings without creative due diligence, in which.

DETAILED DESCRIPTION OF PREFERRED EMBODIMENT

The following accompanying appendix drawings in accordance with the present invention will be used to clearly and completely described technical solutions in accordance with an embodiment of the present invention. Obviously, the described embodiment(s) is merely a part of complete embodiments of the present invention rather than all of them. Based on the embodiment(s) of the present invention, all other embodiments obtained by a person of ordinary skilled in the art without creative due diligence shall fall within the protective claimed scope of the present invention.

Figure 1:
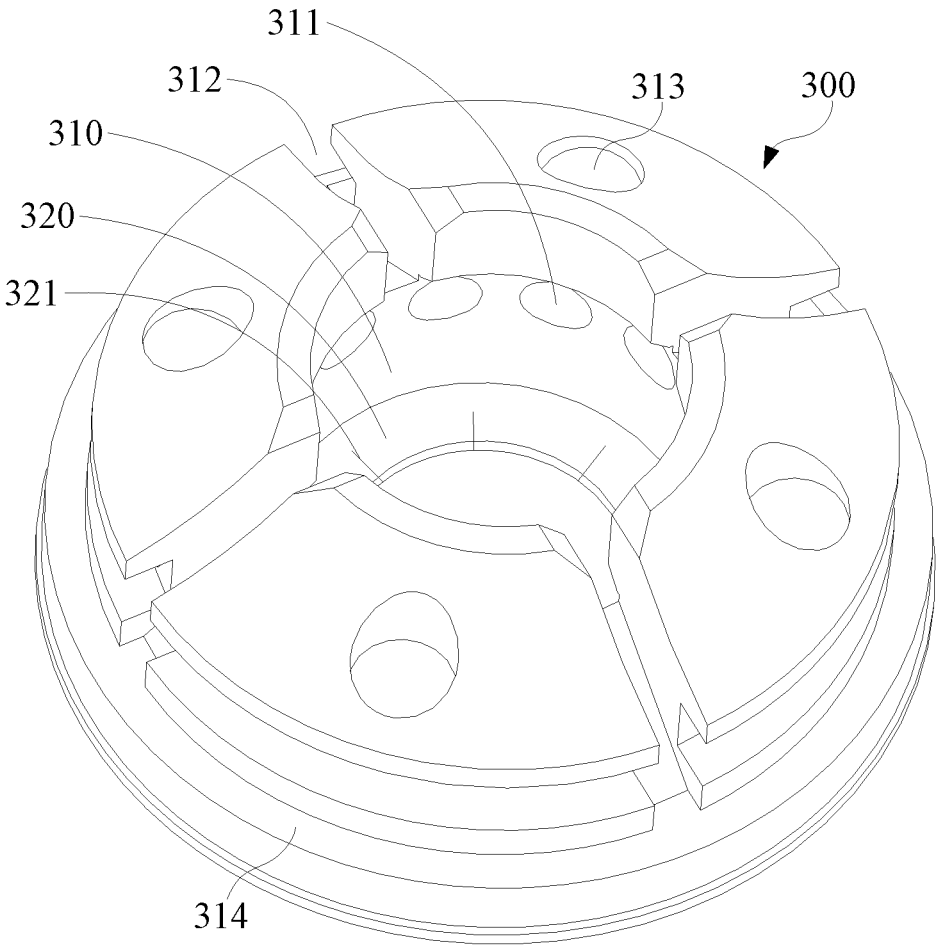
FIG. 1 shows a schematic structural perspective view of an airflow regulator in accordance with a preferred embodiment of the present invention.
Figure 2:
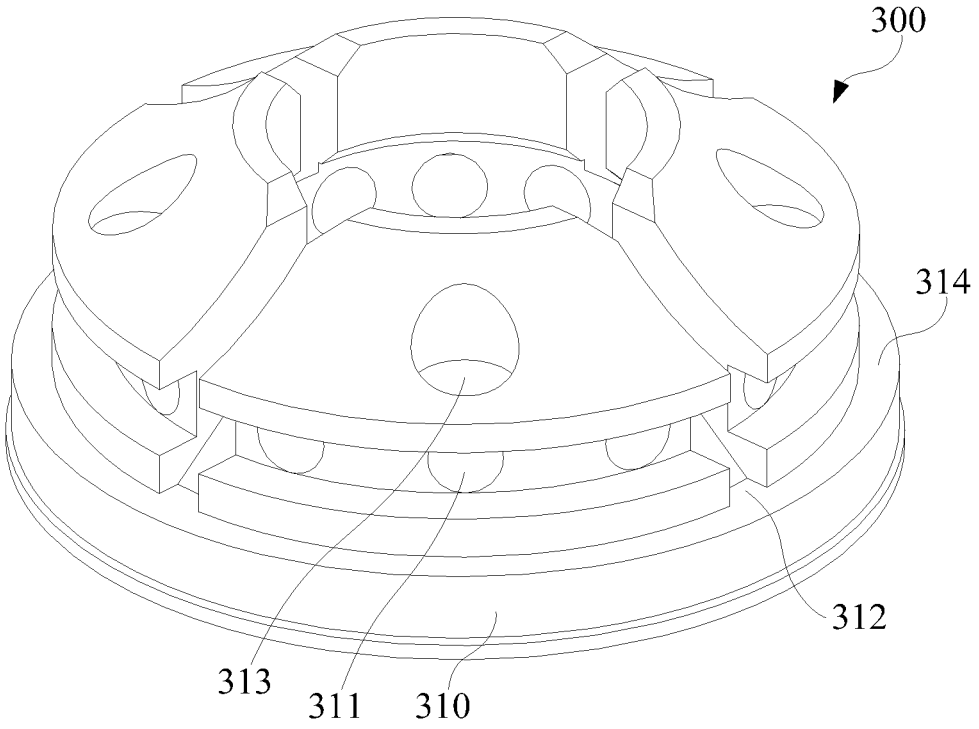
FIG. 2 shows a schematic structural perspective view of the airflow regulator shown in FIG. 1 viewed from another viewing angle in accordance with a preferred embodiment of the present invention.

With reference to FIG. 1 and FIG. 2, an airflow regulator 300 in accordance with an embodiment of the present invention is provided. The airflow regulator 300 comprises a main ring body 310 and a regulating ring piece 320. The main ring body 310 is a hollow structure and a sidewall thereof comprises an air inlet 311. The regulating ring piece 320 is disposed on an inner periphery of the hollow structure, that is the main ring body 310, and is located below the air inlet 311. The regulating ring piece 320 is used to deform correspondingly according to magnitudes of pressures of incoming airflows passing through the air inlet 311. The operating principle of the regulating ring piece 320 is described below.

Preferably, the airflow regulator 300 may be integrally formed by elastic material, such as silicone, etc. The air inlet 311 may be a circular hole, a slot-shaped hole, etc. A number of these holes is not limited by any specific embodiment of the present invention. The regulating ring piece 320 is preferably located at a bottom of the inner periphery of the main ring body 310 and is extending from the bottom of the inner periphery of the main ring body 310 toward a centre of the main ring body 310.

In an embodiment of the present invention, the regulating ring piece 320 may be an integrated body or a piece having one cutting line 321 or a plurality of cutting lines 321 formed along a radial direction of the regulating ring piece 320. When one cutting line 321 or a plurality of cutting lines 321 are disposed long the radial direction of the regulating ring piece 320, the regulating ring piece 320 is divided into two or a plurality of small ring segments. A force required for deformation of the regulating ring piece 320 is relatively smaller than the regulating ring piece 320 being an integrated body.

In an embodiment of the present invention, the main ring body 310 comprises a notch 312 formed along a radial direction of the main ring body 310. The notch 312 is used to be engaged and fit with an inner rib 260 of a suction nozzle 200 (Referring to FIGS. 3 and 4). The main ring body 310 further comprises a counterbore 313 disposed at a top face of the main ring body 310. A space provided by the counterbore 313 facilitates assembly of the airflow regulator 300.

In addition, an outer periphery of the main ring body 310 further comprises an engaging portion 314. The engaging portion 314 is used to engage against an inner contact platform 240 of the suction nozzle 200 (Referring to FIGS. 3 and 4).

Figure 3:
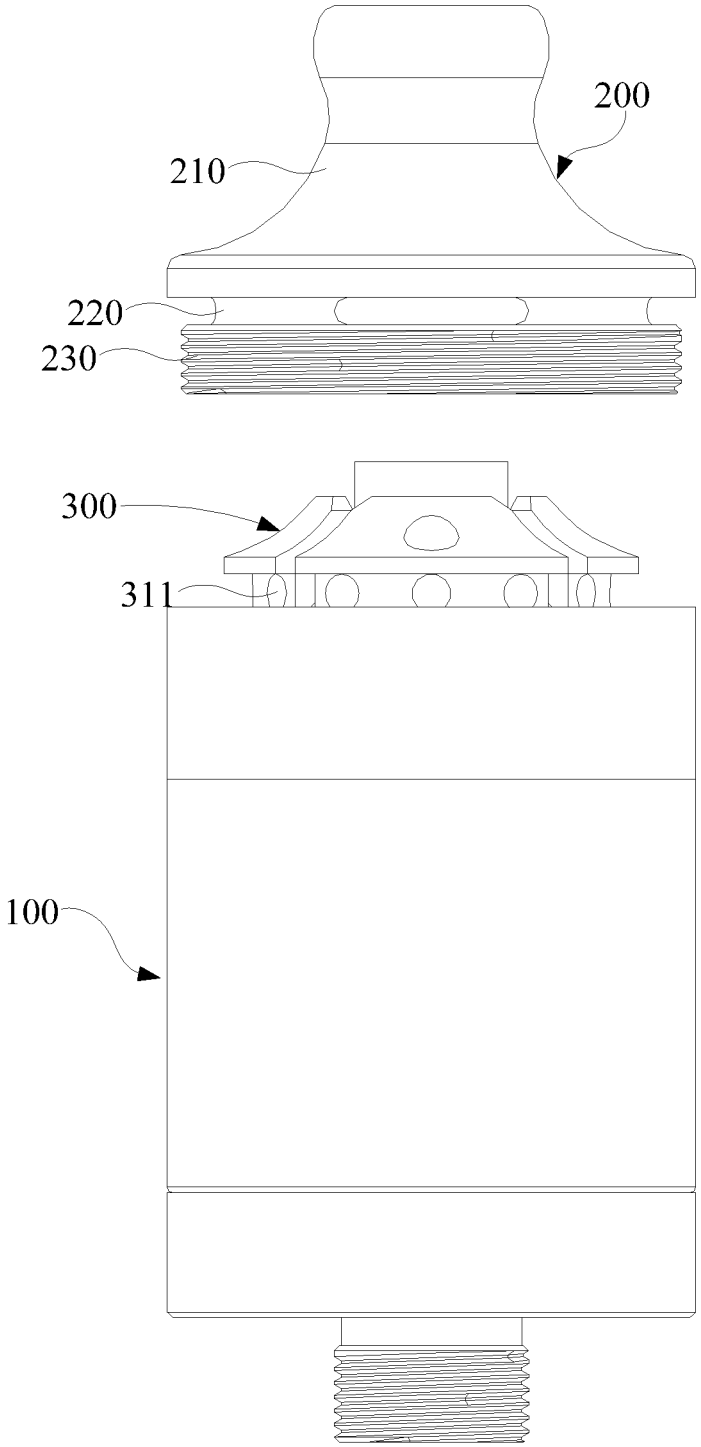
FIG. 3 shows a schematic structural exploded side view of an atomizer in accordance with a preferred embodiment of the present invention.
Figure 4:
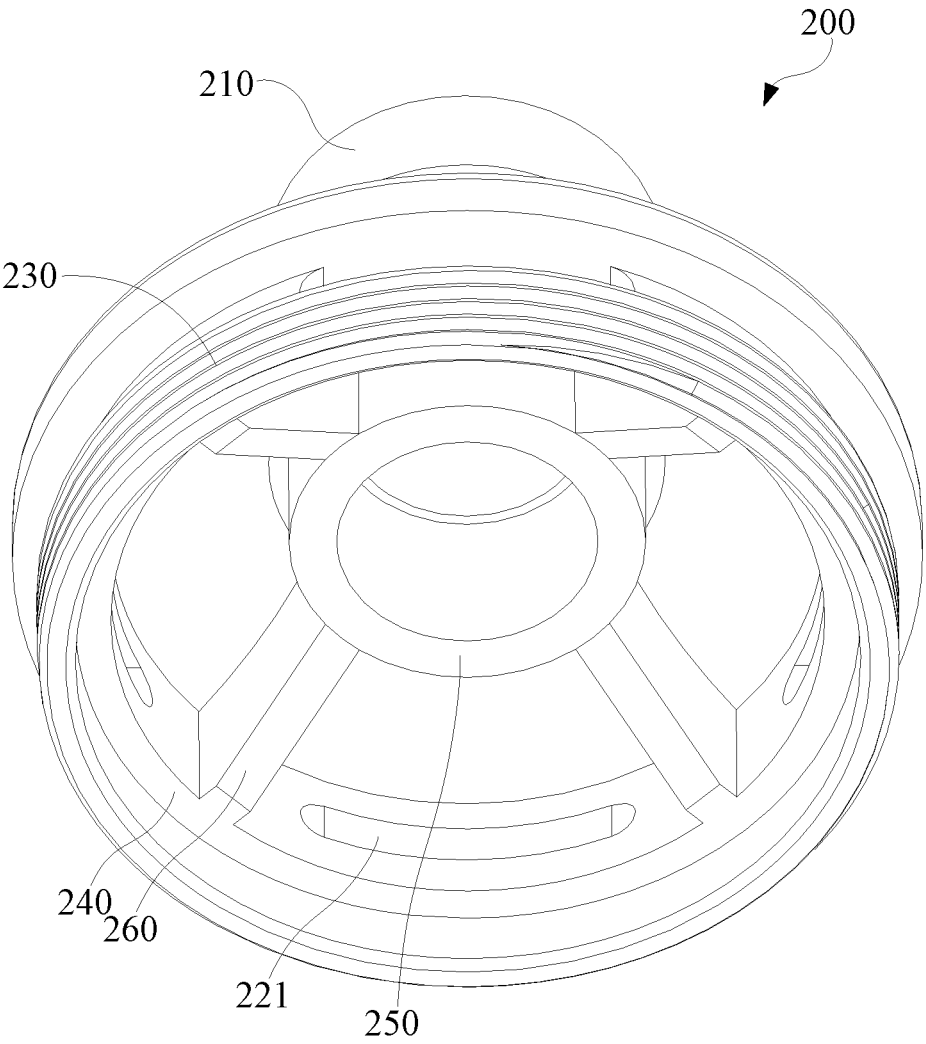
FIG. 4 shows a schematic structural perspective view of a suction nozzle of the atomizer shown in FIG. 3 in accordance with a preferred embodiment of the present invention.
Figure 5:
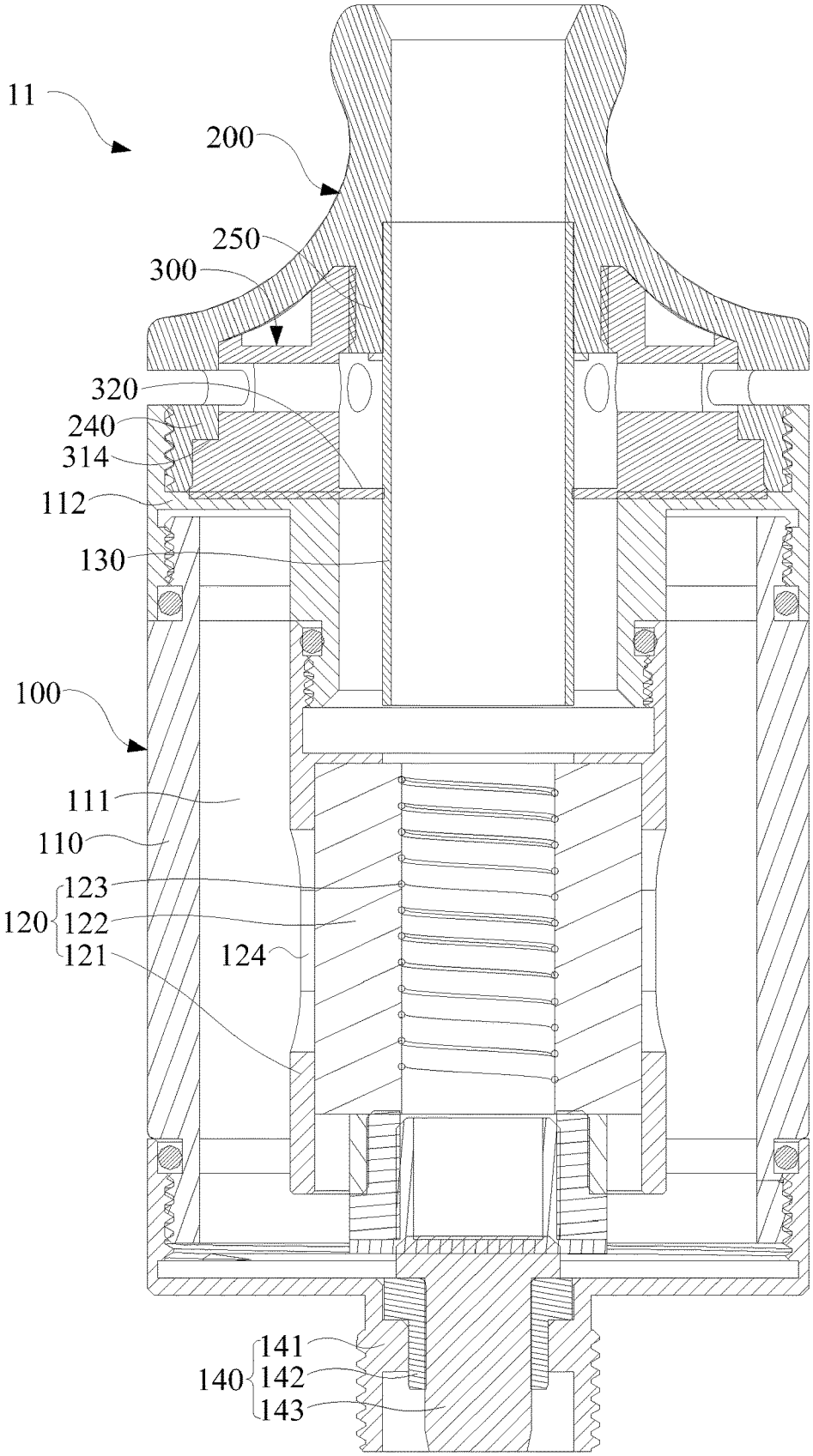
FIG. 5 shows a schematic structural sectional view of the atomizer shown in FIG. 3 in accordance with a preferred embodiment of the present invention.

Please also refer to FIGS. 3 to 5, an atomizer 11 is further provided in accordance with the present invention. The atomizer 11 comprises a main unit 100, the above mentioned suction nozzle 200 connected to the main unit 100 and the airflow regulator 300 described above. In particular, the airflow regulator 300 is disposed between the main unit 100 and the suction nozzle 200. The regulating ring piece 320 of the airflow regulator 300 is used to correspondingly deform according to magnitudes of pressure of airflows passing through the air inlet 311 into an inside of the main unit 100.

Especially, the suction nozzle 200 comprises a body portion 210, an intake ring portion 220 and a screw threaded portion 230. The body portion 210, the intake ring portion 220 and the screw threaded portion 230 are sequentially connected to one another. In particular, the air intake ring portion 220 comprises one or a plurality of air intake slots 221. External air can sequentially pass through the air intake slot 221, the air inlet 311 and the regulating ring piece 320 into the main unit 100. The screw threaded portion 230 is used to be connected with screw threads of the main unit 100. The suction nozzle 200 can be integrally made of ceramic, plastic or stainless steel.

In an embodiment of the present invention, the suction nozzle 200 further comprises the above mentioned inner contact platform 240, an inner sleeve 250, and the above mentioned inner rib 260. The inner contact platform 240 is used to be pressingly engaged around the outer periphery of the main ring body 310, and more specifically, to be pressingly engaged on the engaging portion 314 of the main ring body 310. The inner sleeve 250 is used to be connectively sleeved with the inner periphery of the main ring body 310. The inner rib 260 is used to be engaged and fit with the top face of the main ring body 310, and more specifically, to be engaged and fit with the slot 312 of the main ring body 310.

In an embodiment of the present invention, the main unit 100 comprises an outer cylinder 110, an atomizing assembly 120, a central conduit 130 and an electrical connection base 140.

An oil reservoir 111 is formed by and between an inner periphery of the outer cylinder 110 and an outer periphery of the atomizing assembly 120. Both ends of the central conduit 130 are respectively connected with the inner sleeve 250 and the atomizing assembly 120. The regulating ring piece 320 is resiliently engaged around an outer peripheral wall of the central conduit 130. The electrical connection base 140 is connected to a bottom of the outer cylinder 110 for supplying power to the atomizing assembly 120. The outer cylinder 110 may be a cylindrical, a square prism, or a polygonal prism, and may be made of ceramic, plastic, or stainless steel. In an embodiment of the present invention, a connecting seat 112 is disposed at a top of the outer cylinder 110 in order to be connectively screwed with the suction nozzle 200, and with top screw threads of the atomizing assembly 120, respectively.

In an embodiment of the present invention, the atomizing assembly 120 comprises an inner cylinder body 121, an oil absorbing body 122 disposed in the inner cylinder body 121, and a heating wire 123 disposed in the oil absorbing body 122. The inner cylinder body 121 comprises an oil sucking hole 124 to allow tobacco oils stored in the oil reservoir 111 entering the oil absorbing body 122 through the oil sucking hole 124. The entering tobacco oils of the oil absorbing body 122 are heated and atomized by the heating wire 123. The atomized tobacco oils then exit via conduction of the central conduit 130.

In an embodiment of the present invention, the electrical connection base 140 comprises a negative electrode bottom case 141, a bottom case insulating sleeve 142, and a positive electrode connecting rod 143. The positive electrode connecting rod 143 is inserted and disposed in the negative electrode bottom case 141 via electrical insulation of the bottom case insulating sleeve 142 from the negative electrode bottom case 141. The negative electrode bottom case 141 and the positive electrode connecting rod 143 are further electrically connected to the heating wire 123 in order to supply power to the heating wire 123 when the electrical connection base 140 is externally electrically connected to a battery.

When a user smokes by using the atomizer 11 comprising the airflow regulator 300, sucking forces of the user applying on the suction nozzle 200 causes low air pressure inside the atomizer 11. The caused low air pressure results in a drawing force to pull the regulating ring piece 320 downward (Referring to FIG. 3). At this moment, a free end (an inner peripheral portion of the regulating ring piece 320) of the regulating ring piece 320 deforms under influence of the drawing force, and separates away from the outer peripheral wall of the central conduit 130 to achieve air intake. The magnitudes of the sucking forces of the user applying on the suction nozzle 200 is positively proportional to an extent of deformation of the free end of the regulating ring piece 320. When the sucking force of the user applying on the suction nozzle 200 is larger, the extent of deformation of the free end of the regulating ring piece 320 is higher. A gap formed due to separation of the free end of the regulating ring piece 320 away from the outer peripheral wall of the central conduit 130 is larger, and therefore an amount of air intake is larger. When the sucking force of the user applying on the suction nozzle 200 is smaller, the extent of deformation of the free end of the regulating ring piece 320 is lower. A gap formed due to separation of the free end of the regulating ring piece 320 away from the outer peripheral wall of the central conduit 130 is smaller, and therefore an amount of air intake is smaller. Hence, the above mentioned function of the regulating ring piece 320 being used to correspondingly deform according to magnitudes of pressure of incoming airflows passing through the air inlet 311 can be achieved.

Figure 6:
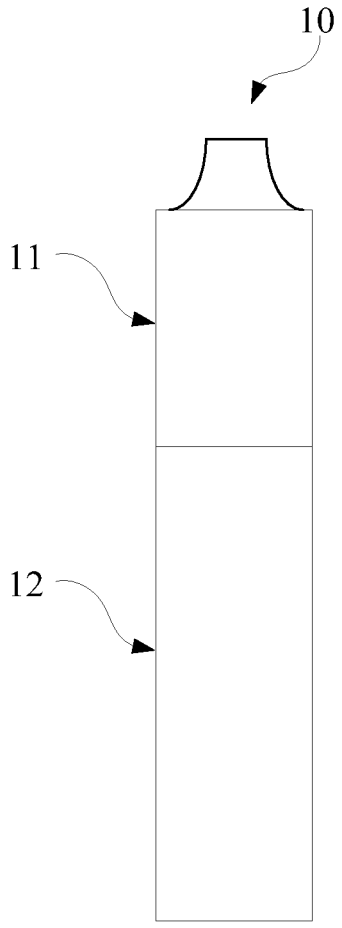
FIG. 6 shows a schematic structural side view of an electronic cigarette in accordance with a preferred embodiment of the present invention.

Please also referring to FIG. 6, an electronic cigarette 10 in accordance with the present invention is further provided. The electronic cigarette 10 comprises a battery module 12 and the atomizer 11 described above.

In summary, those skilled in related art can easily understand that the electronic cigarette 10, the atomizer 11 and the airflow regulator 300 provided in accordance with the present invention are structurally novel and convenient to use, and the regulating ring piece 320 thereof can correspondingly deform according to magnitudes of sucking forces of the user when the user smokes in order to automatically adjust the amount of air intake. As a result, smoking experience of the user can be extremely enhanced.

The above is merely embodiment(s) of the present invention, and therefore does not limit the claimed scope of the present invention. Any equivalent structure or equivalent process transformation made according to the content of specification and appendix drawings of the present invention, or direct or indirect application of the present invention on other technical fields shall equally fall within the claimed scope of claims of the present invention as follows.

What is claimed is:

1. An airflow regulator comprising a main ring body and a regulating ring piece, wherein the main ring body is a hollow structure and a sidewall thereof comprises an air inlet, the regulating ring piece is disposed on an inner periphery of the hollow structure of the main ring body; wherein the regulating ring piece extends from a bottom of the inner periphery of the main ring body toward a centre of the main ring body, the regulating ring piece is configured to deform correspondingly according to magnitudes of pressures of incoming airflows passing through the air inlet.

2. The airflow regulator as claimed in claim 1, wherein a cutting line is formed along a radial direction of the regulating ring piece.

3. The airflow regulator as claimed in claim 1, wherein a notch is formed along a radial direction of the main ring body.

4. The airflow regulator as claimed in claim 1, wherein a counterbore is disposed at a top face of the main ring body.

5. The airflow regulator as claimed in claim 1, wherein an engaging portion is disposed at an outer periphery of the main ring body.

6. An atomizer comprising a main unit, a suction nozzle connected to the main unit and an airflow regulator comprising a main ring body and a regulating ring piece, wherein the main ring body is a hollow structure and a sidewall thereof comprises an air inlet, the regulating ring piece is disposed on an inner periphery of the hollow structure of the main ring body; wherein the regulating ring piece extends from a bottom of the inner periphery of the main ring body toward a centre of the main ring body, wherein the airflow regulator is disposed between the main unit and the suction nozzle, the regulating ring piece of the airflow regulator is configured to correspondingly deform according to magnitudes of pressures of airflows passing through the air inlet into an inside of the main unit.

7. The atomizer as claimed in claim 6, wherein a cutting line is formed along a radial direction of the regulating ring piece.

8. The atomizer as claimed in claim 6, wherein a notch is formed along a radial direction of the main ring body; a counterbore is disposed at a top face of the main ring body.

9. The atomizer as claimed in claim 6, wherein an engaging portion is disposed at an outer periphery of the main ring body.

10. The atomizer as claimed in claim 6, wherein the suction nozzle comprises a body portion, an intake ring portion and a screw threaded portion which are sequentially connected to one another, the air intake ring portion comprises an air intake slot, external air sequentially passes through the air intake slot, the air inlet and the regulating ring piece into the main unit, the screw threaded portion is used to be connected with screw threads of the main unit.

11. The atomizer as claimed in claim 10, wherein the suction nozzle further comprises an inner contact platform, an inner sleeve and an inner rib, the inner contact platform is used to be pressingly engaged around an outer periphery of the main ring body, the inner sleeve is used to be connectively sleeved with the inner periphery of the main ring body, the inner rib is used to be engaged and fit with a top face of the main ring body.

12. The atomizer as claimed in claim 11, wherein the main unit comprises an outer cylinder, an atomizing assembly, a central conduit and an electrical connection base, an oil reservoir is formed between an inner periphery of the outer cylinder and an outer periphery of the atomizing assembly, both ends of the central conduit are respectively connected with the inner sleeve and the atomizing assembly, the regulating ring piece is resiliently engaged around an outer peripheral wall of the central conduit, the electrical connection base is connected to a bottom of the outer cylinder.

13. An electronic cigarette comprising a battery module and an atomizer; wherein the atomizer comprises a main unit, a suction nozzle connected to the main unit and an airflow regulator comprising a main ring body and a regulating ring piece, wherein the main ring body is a hollow structure and a sidewall thereof comprises an air inlet, the regulating ring piece is disposed on an inner periphery of the hollow structure of the main ring body; wherein the regulating ring piece extends from a bottom of the inner periphery of the main ring body toward a centre of the main ring body, wherein the airflow regulator is disposed between the main unit and the suction nozzle, the regulating ring piece of the airflow regulator is configured to correspondingly deform according to magnitudes of pressures of airflows passing through the air inlet into an inside of the main unit.

14. The electronic cigarette as claimed in claim 13, wherein a cutting line is formed along a radial direction of the regulating ring piece.

15. The electronic cigarette as claimed in claim 13, wherein a notch is formed along a radial direction of the main ring body; a counterbore is disposed at a top face of the main ring body.

16. The electronic cigarette as claimed in claim 13, wherein an engaging portion is disposed at an outer periphery of the main ring body.

17. The electronic cigarette as claimed in claim 13, wherein the suction nozzle comprises a body portion, an intake ring portion and a screw threaded portion which are sequentially connected to one another, the air intake ring portion comprises an air intake slot, external air sequentially passes through the air intake slot, the air inlet and the regulating ring piece into the main unit, the screw threaded portion is used to be connected with screw threads of the main unit.

18. The electronic cigarette as claimed in claim 17, wherein the suction nozzle further comprises an inner contact platform, an inner sleeve and an inner rib, the inner contact platform is used to be pressingly engaged around an outer periphery of the main ring body, the inner sleeve is used to be connectively sleeved with the inner periphery of the main ring body, the inner rib is used to be engaged and fit with a top face of the main ring body.

19. The electronic cigarette as claimed in claim 18, wherein the main unit comprises an outer cylinder, an atomizing assembly, a central conduit and an electrical connection base, an oil reservoir is formed between an inner periphery of the outer cylinder and an outer periphery of the atomizing assembly, both ends of the central conduit are respectively connected with the inner sleeve and the atomizing assembly, the regulating ring piece is resiliently engaged around an outer peripheral wall of the central conduit, the electrical connection base is connected to a bottom of the outer cylinder.

* * * * *